US005295527A

United States Patent [19]

West

[11] Patent Number: 5,295,527

[45] Date of Patent: Mar. 22, 1994

[54] FOLDING DOOR SYSTEM

[75] Inventor: Floyd D. West, Galena, Ill.

[73] Assignee: Rite-Hite Corporation, Milwaukee, Wis.

[21] Appl. No.: 937,535

[22] Filed: Aug. 28, 1992

Related U.S. Application Data

[63] Continuation of Ser. No. 490,335, Mar. 8, 1990, Pat. No. 5,143,137.

[51] Int. Cl.[5] ..... E05D 15/26

[52] U.S. Cl. ..... 160/199; 160/349.2

[58] Field of Search ..... 160/199, 229.1, 349.1, 160/196.1, 228, 206, 332, 184, DIG. 7, 135; 52/406; 24/115 F, 306, 300, 301, 302

[56] References Cited

U.S. PATENT DOCUMENTS

| | | | |
|---|---|---|---|
| 2,319,292 | 5/1943 | Boggs | 160/349.1 X |
| 2,538,429 | 1/1951 | Schantz . | |
| 3,001,578 | 9/1961 | Ratliff | 160/349.1 X |
| 3,033,283 | 5/1962 | Jorgensen . | |
| 3,494,407 | 2/1970 | Hollands et al. . | |
| 4,274,467 | 6/1981 | Comeau | 160/199 X |
| 4,380,260 | 4/1983 | Labelle . | |
| 4,432,406 | 2/1984 | Belanger et al. | 160/118 X |
| 4,535,828 | 8/1985 | Brockhaus . | |
| 4,574,862 | 3/1986 | Rejc | 160/199 |
| 4,874,028 | 10/1989 | Lynch et al. . | |
| 4,887,659 | 12/1989 | West | 160/199 |
| 4,957,600 | 9/1990 | Carlson et al. | 160/118 X |
| 4,961,454 | 10/1990 | Reilly, Jr. et al. | 160/118 X |
| 5,025,846 | 6/1991 | West | 160/199 |

*Primary Examiner*—Blair M. Johnson

*Attorney, Agent, or Firm*—Leydig, Voit & Mayer, Ltd.

[57] ABSTRACT

A panel for a multi-panel folding door includes a semi-rigid, transparent partition with insulating layers disposed on opposing sides thereof. A collapsible nose seal adjacent to a lateral edge of the panel and extending substantially the length thereof is adapted for engagement with another similar panel also having a collapsible nose seal to provide an interlocking, insulated seal between the panels when the door is closed while permitting the panels to be separated when the door is opened. A magnet in the collapsible nose seal of each panel is adapted for magnetic coupling to a metal plate in the other panel to provide a weather-tight, thermal insulating seal. Each of the insulating layers includes an aperture, with the apertures in mutual alignment to form a window in the panel.

7 Claims, 7 Drawing Sheets

FIG. 6
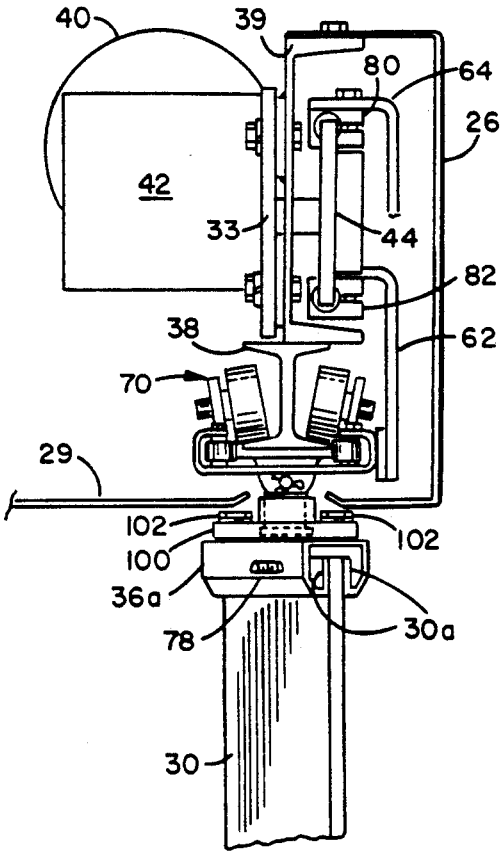
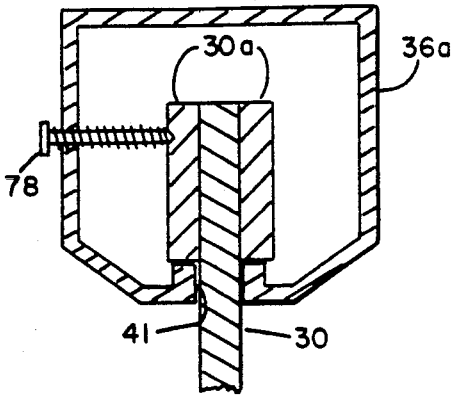
FIG. 7
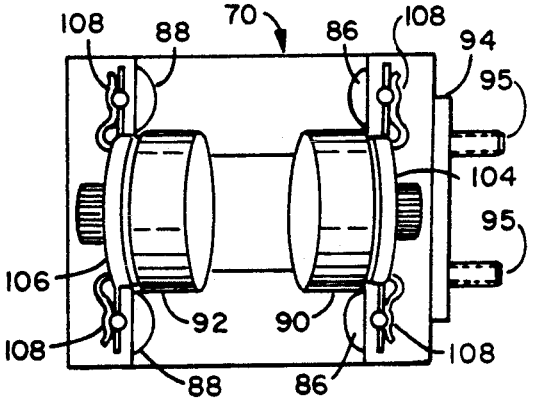
FIG. 8
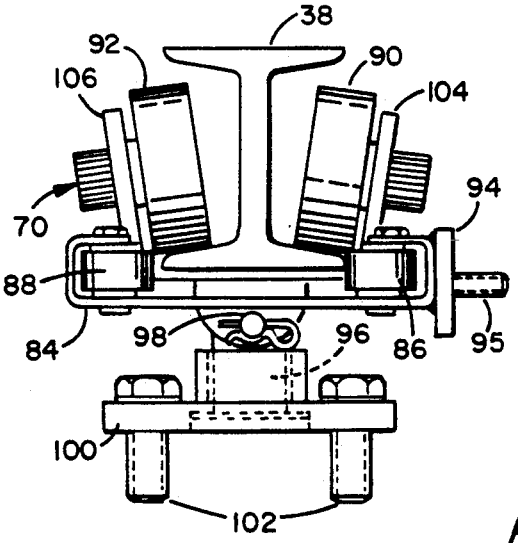
FIG. 9
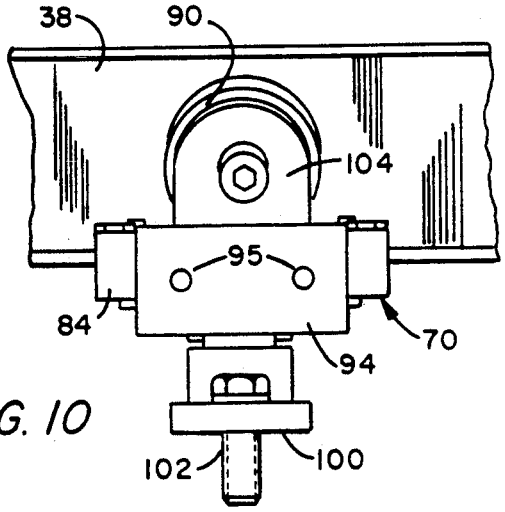
FIG. 10

FOLDING DOOR SYSTEM

This is a continuation of copending application Ser. No. 07/490,335, filed on Mar. 8, 1990, now U.S. Pat. No. 5,143,137.

BACKGROUND OF THE INVENTION

This invention relates generally to multi-section, high speed, motor driven, impact-resistant folding doors and is particularly directed to an improved seal for the lead, or center, panels of a multi-section folding door.

Electrically operated folding partitions, or doors, having a plurality of vertically oriented panels are commonly used in doorways to provide isolation between two rooms or between the outside and inside of a building. Such folding partitions are also frequently used to divide off two or more areas of a given room. The vertically oriented panels are typically suspended from a longitudinal, horizontal track along which the panels are movable. The panels may be coupled together in an accordian-like manner or they may be detached from one another such as in a strip door. Where the panels are coupled together, they are automatically positioned in a straight line, flat arrangement when in the fully closed position and are automatically moved to a folded, stacked configuration when in the fully open position. Such structures are often referred to as operable walls in that they provide a movable wall section for space isolation purposes.

These types of multi-panel folding doors are frequently sometimes used in low temperature environments to isolate those areas on opposing sides of the door. Perhaps the most common low temperature application of these doors is in freezers. In this environment, the individual panels are preferably comprised of materials capable of withstanding low temperatures without deforming or cracking particularly upon impact by a moving object such as a vehicle. When the door is open, there is inevitably a reduction in the temperature differential across the doorway. Present multi-panel folding doors offer only a limited insulating and sealing capability when closed for isolating adjacent spaces separated by the door. Available folding doors are subject to heat leakage particularly in the area of the overlapping lead, or center, panels and thermal transmission through the individual panels which are thin and lightweight because of the high speeds at which those doors are required to operate.

The present invention is intended to overcome the aforementioned limitations of the prior art by providing a multi-panel, high speed folding door having insulated panels which are particularly adapted for use in low temperature environments such as in freezers. The two lead, or inner, panels are provided with respective overlapping collapsible nose seals which incorporate a magnetic coupler for an improved seal in the center portion of the door. Each panel includes a center transparent, sheet-like partition and an insulating sheet on each side of the transparent partition with aligned apertures for more easily and inexpensively providing the panel with a window.

OBJECTS AND SUMMARY OF THE INVENTION

Accordingly, it is an object of the present invention to provide a multi-panel folding door with improved sealing characteristics.

It is another object of the present invention to provide an interlocking seal for the panels of a multi-section folding door.

Yet another object of the present invention is to provide improved thermal insulation in a multi-section folding door for use in low temperature environments.

A further object of the present invention is to provide a collapsible magnetic seal between adjacent panels in a folding door.

A still further object of the present invention is to provide improved sealed engagement between insulated lead panels of a folding door used in a low temperature environment.

Yet another object of the present invention is to facilitate the manufacture and reduce the cost of an insulated panel with a window used in a multi-panel folding door.

Another object of the present invention is to provide a multi-section folding door particularly adapted for use in low temperature environments such as in freezers.

Yet another object of the present invention is to provide an insulated panel having a magnetic seal on its inner edge which overlaps another similar panel for use in an impact resistant high speed folding door operating in a low temperature environment.

This invention contemplates a panel for use in a high speed folding door having a plurality of such panels suspended from an overhead track and drive means for moving the panels between an open and a closed position, wherein the panels are adapted for mutually overlapping positioning when the door is closed, with each of the panels comprising: a sheet-like, flexible partition comprised of a transparent material; first and second insulating layers disposed on opposed surfaces of the flexible partition, wherein each of the insulating layers includes a respective aperture therein and wherein the apertures in each of the insulating layers are in mutual alignment to form a window in the panel; and breakaway double interlocking seal means disposed on overlapping edge portions of the panels for connecting the panel to another similar panel in a sealed manner when the door is closed while allowing for separation of the panels when the door is opened.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 6 is a sectional view of the trolley and curtain support portions of the folding door of the present invention;

FIG. 7 is a sectional view illustrating details of the manner in which the individual panels, or curtains, are positioned within and supported by a support bar, or arm;

FIG. 8 is a top plan view of a trolley which allows for horizontal movement of the individual panels of the folding door of the present invention;

FIG. 9 is a sectional view taken transverse to a folding door support beam as used in the present invention illustrating additional details of a trolley mounted to the support beam;

FIG. 10 is a lateral view of the trolley arrangement illustrated in FIG. 9;

DETAILED DESCRIPTION OF THE PREFERRED EMBODIMENT

Figure 1:
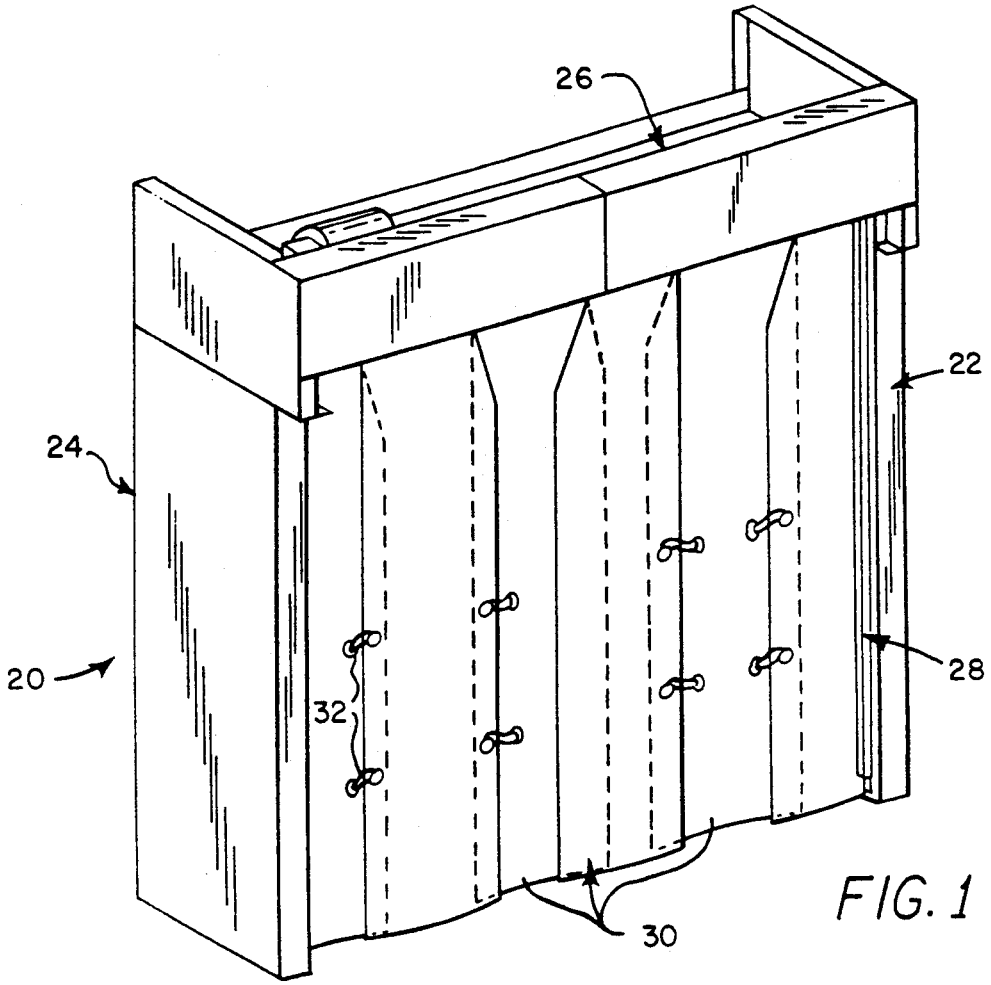
FIG. 1 is an upper, front perspective view of a folding door in accordance with the principles of the present invention.

Referring to FIG. 1, there is shown an upper, front perspective view of a high speed folding door 20 in which the present invention is intended for use. The folding door 20 includes right and left side frames 22, 24 as well as a header assembly 26. The header assembly 26 extends between and is coupled to respective upper end portions of the right and left side frames 22, 24. The header assembly 26 and side frames 22, 24 are typically disposed about or adjacent to an opening in a wall through which vehicles and workers pass.

The header assembly 26 and side frames 22, 24 are preferably comprised of a high strength metal, but may also be fabricated from wood or plastic or other conventional construction materials which provide sufficient strength and rigidity to support the folding door and various components associated therewith. Suspended from the header assembly 26 are a plurality of vertically oriented panels 30 which are shown in the closed position in FIG. 1. When closed, the panels 30 are disposed in a generally planar array in an edge overlapping manner. As shown in FIG. 1, there are six panels 30 although the present invention is not limited to this specific number. In order to open the folding door 20, the panels 30 are first linearly displaced outwardly toward one of the side panels. Thus, three of the panels are drawn toward the right side frame 22, while the remaining three panels are drawn toward the left side frame 24 in opening the folding door. Each of the panels 30 is pivotally coupled to an suspended from a trolley mechanism (not shown in the figure) which is described in detail below. As the panels are drawn outwardly, they undergo rotational displacement so as to assume a stacked array of generally parallel panels. Adjacent panels 30 are coupled together by one or more breakaway retaining straps 32. A right stile 28 is coupled to the right side frame 22, while a left stile (which is not shown in FIG. 1) is coupled to and supported by the left side frame 24. Each of the stiles provides support for a panel support and displacement arrangement positioned within the header assembly 26 and described in detail in the following paragraphs.

Figure 3:
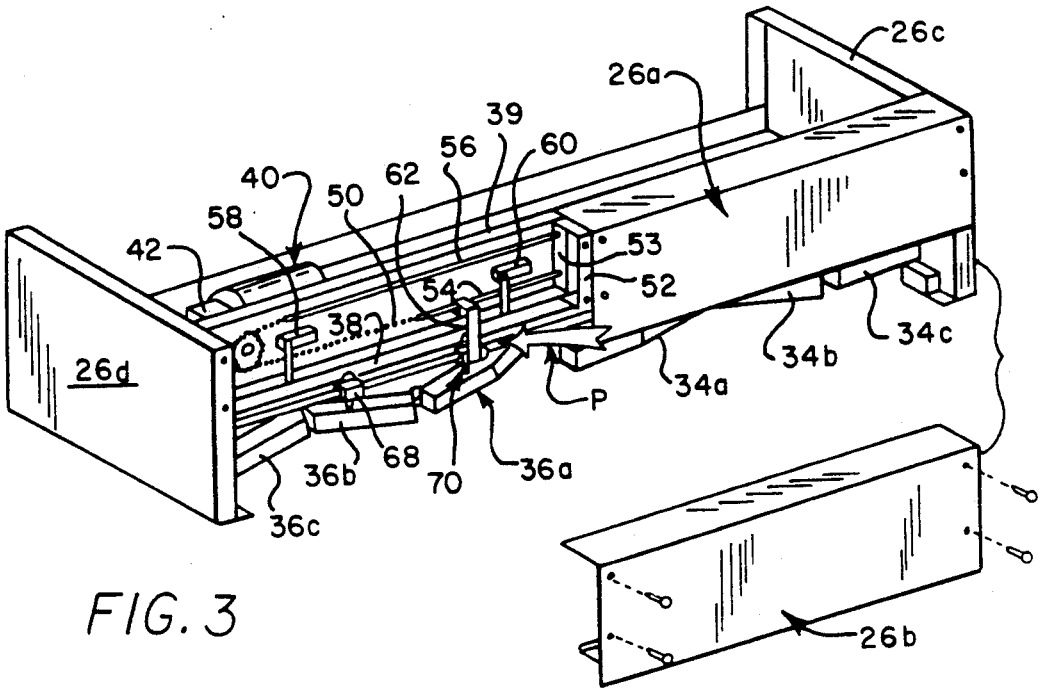
FIG. 3 is a perspective view of the header and support portion of the folding door illustrated in FIGS. 1 and 2.
Figure 2:
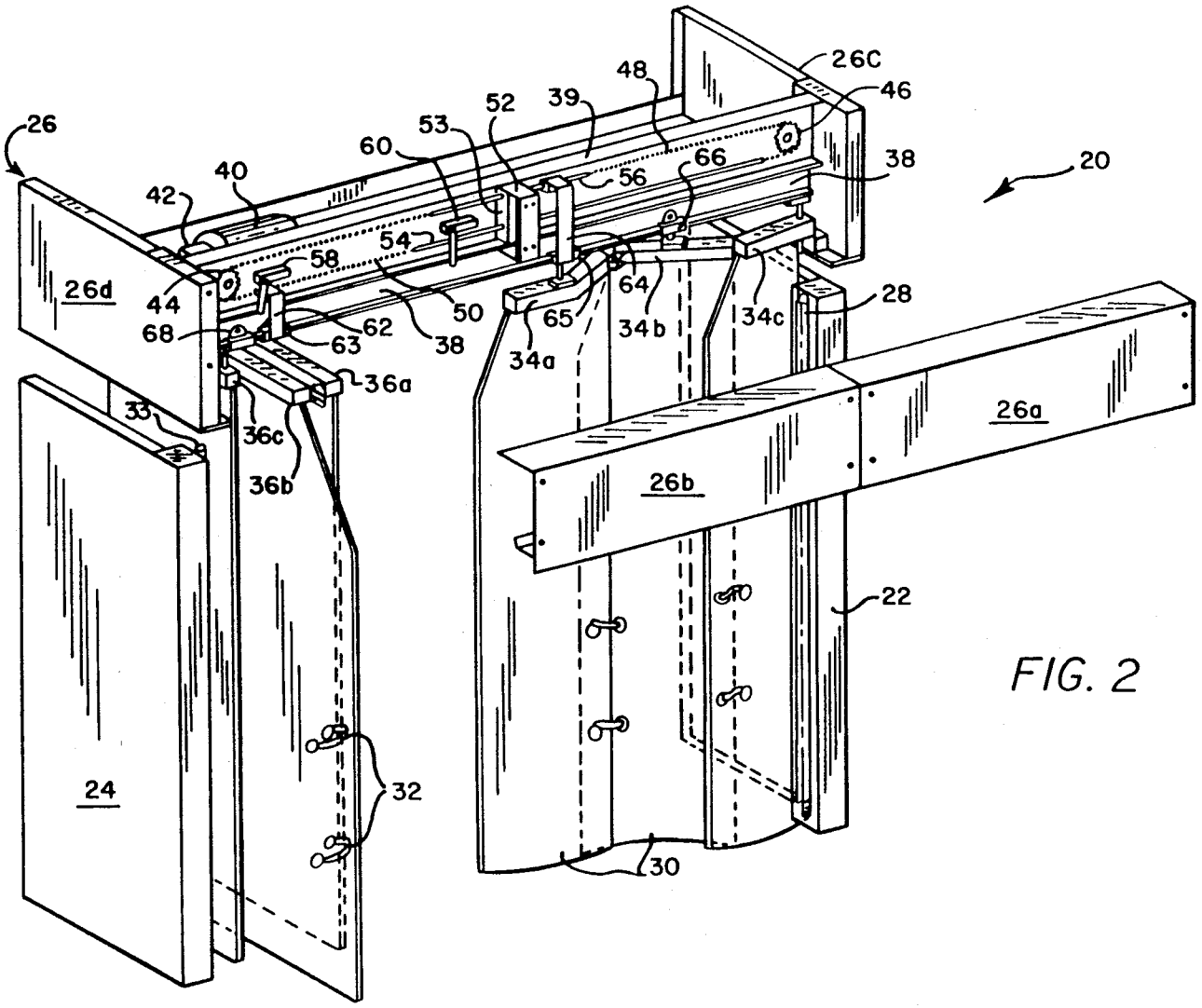
FIG. 2 is an upper perspective, exploded view of a folding door in accordance with the present invention.

Referring to FIG. 2, there is shown a partially exploded, upper perspective view of the folding door 20. FIG. 3 is a perspective view of an upper portion of the folding door illustrating details of the header assembly 26 and panel support and transport arrangement. The header assembly 26 includes right and left front sections 26*a* and 26*b* as well as right and left end sections 26*c* and 26*d*. The right and left end sections 26*c*, 26*d* are typically disposed within or adjacent to upper corners of an opening within a wall across which the folding door 20 spans. The right and left side frames 22, 24 are adapted for secure coupling at respective upper ends thereof to the right and left end sections 26*c*, 26*d* of the header assembly 26. Similarly, the right and left front sections 26*a*, 26*b* are adapted for secure attachment to forward edge portions of the right and left end sections 26*c*, 26*d* of the header assembly 26 as well as to the center bracket 52.

Disposed between and coupled to each of the right and left end sections 26*c*, 26*d* of the header assembly 26 are an upper support beam 39 and a lower I-beam 38. The upper support beam and the I-beam 38 may be coupled together by conventional means such as bolts, coupling brackets, or weldments. In addition, the support beam 39 and the I-beam 38 are securely coupled at respective ends thereof to the right and left end sections 26*c*, 26*d* of the header assembly 26.

Positioned aft of and adjacent to the support beam 39 is an electric drive motor 40. Coupled to the drive motor 40 is a gear box 42 which, in turn, is coupled by means of a drive shaft to a drive sprocket 44 which is positioned adjacent to and forward of the support beam 39. The shaft upon which the drive sprocket 44 is mounted extends through the support beam 39. Mounted to the other end of the support beam 39 in a freely rotatably manner by means of an idle shaft is an idle sprocket 46. Disposed about the drive and idle sprockets 44, 46 is the combination of a first chain 48, a second chain 50, a first drawbar 54, and a second drawbar 56. The first chain 48 is disposed about the idle sprocket 46 and is coupled at respective ends thereof to the first and second drawbars 54, 56. Similarly, the second chain 50 is disposed about the drive sprocket 44 and securely coupled at respective ends thereof to the first and second drawbars 54, 56. The combination of the aforementioned pairs of chains and drawbars forms an endless member which may be rotationally displaced by means of the drive motor 40 via the gear box 42 and drive sprocket 44. The first and second drawbars 54, 56 are inserted through and maintained in mutual alignment by a guide block 53. Guide block 53 includes a pair of apertures therein through each of which is inserted a respective one of the drawbars. Guide blocks 53 is securely maintained in a fixed position and is mounted to the support bar 39.

Coupled to the second drawbar 56 and disposed to the right of the center bracket 52 is a right moving bracket 64. Coupled to the first drawbar 54 and disposed to the left of the center bracket 52 is a left moving bracket 62. An upper end of the right moving bracket 64 is coupled to the second drawbar 56 while a lower end thereof is coupled to a trolley which engages a lower portion of the I-beam 38. Similarly, an upper end of the left moving bracket 62 is affixed to the first drawbar 54, while a trolley is attached to a lower end of the left moving bracket 62, with the trolley slidably engaging a lower portion of the I-beam 38. Each of the left and right moving brackets 62, 64 may be disconnected from its associated drawbar to permit the folding door to be opened manually without the aid of the drive motor 40. This is shown for the case of the left moving bracket 62 in FIG. 2, where the left moving bracket 62 has been disconnected from the first drawbar 54 and moved to the left adjacent to the second chain 50 where the three leftmost panels of the folding door have been manually moved to the open, or retracted, position. In order to manually open the left hand section of the door, a force must be applied as shown by the arrow designated by the letter "P" in FIG. 3. Alternatively, a trolley may be disconnected from its associated moving bracket to allow the folding door to be manually opened or closed.

Also mounted to the support beam 39 on a forward surface thereof and disposed between the drive and idle sprockets 44, 46 are open and close limit switches 58 and 60. Each of the limit switches 58, 60 is provided with a pivoting arm which is adapted for engagement by the left moving bracket 62 as the folding door 20 is closed and opened. The open limit switch 58 detects full leftward displacement of the left moving bracket 62 indicating that the folding door is in the full open position. Similarly, the close limit switch 60 detects full rightward displacement of the left moving bracket 62 indicating that the folding door 20 is in the fully closed position. Upon detection by the open limit switch 58 that the folding door is in the full open position and upon detection by the close limit switch 60 that the folding door is in the fully closed position, an appropriate signal is provided to the drive motor 40 to terminate further displacement of the folding door.

As stated above, attached to a lower portion of the left moving bracket 62 is a first trolley 63, while attached to a lower portion of the right moving bracket 64 is a second trolley 65. The first trolley 63 is coupled to and provides support for a left lead, or center, arm 36*a*. Similarly, the second trolley 65 is coupled to and provides support for a right lead, or center, arm 34*a*. Additional trolleys 66, 68 are also coupled to and suspended from the I-beam 38. In addition, the trolleys 66, 68 are coupled to and provide support for right and left intermediate arms 34*b* and 36*b*, respectively. Each of the aforementioned trolleys is adapted for sliding displacement along a lower portion of the I-beam 38 to allow the center and intermediate arms to be displaced toward and away from the center of the I-beam 38. A right end arm 34*c* is pivotally coupled to the right end section 26*c* of the header assembly 26, while a left end arm 36*c* is pivotally coupled to and supported by the left end section 26*c*. The right and left end arms 34*c*, 36*c* are pivotally coupled respectively to the right and left intermediate arms 34*b* and 36*b* by respective hinge means. Similarly, the other ends of each of the right and left intermediate arms 34*b*, 36*b* are respectively coupled to the right and left lead arms 34*a*, 36*a* by hinge means. Each of the aforementioned intermediate and lead arms is free to pivot about the trolley to which it is coupled and from which it is suspended. Thus, displacement of the various trolleys along the length of the I-beam 38 permits the two sets of lead, intermediate, and end arms to be drawn toward or away from the center of an aperture across which the I-beam 38 extends. As shown in FIG. 2, a panel 30 extends from and is supported by a respective one of the lead, intermediate, and end arms and is either displaced across the opening or withdrawn from the opening depending upon the displacement and positioning of each of the aforementioned arms. As shown in the figures, the right and left lead arms 34*a* and 36*a* are angled along the length thereof to provide an off-center arrangement to facilitate initial opening of the folding door and displacement of two lead panels along the I-beam 38.

Figure 4:
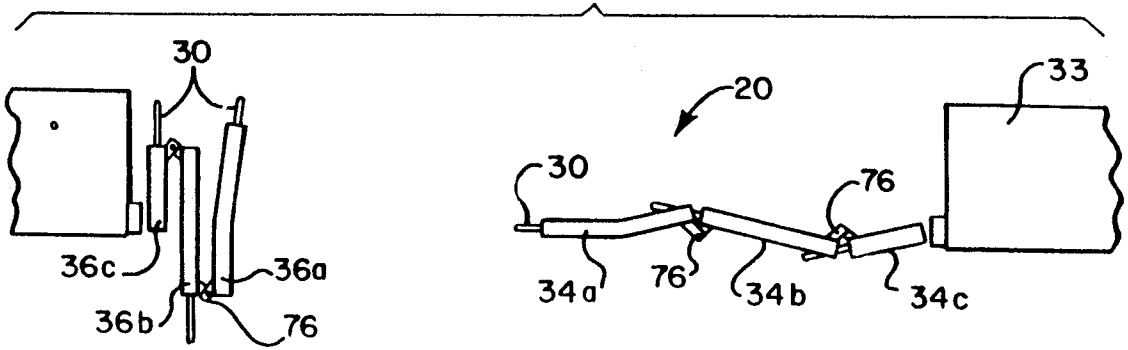
FIG. 4 is a top plan view of the folding door of the present invention showing the right hand section of the door in the closed position and its left hand section in the open position.

Referring to FIG. 4, there is shown a top plan view in simplified schematic diagram form of the folding door 20. As shown in FIG. 4, each adjacent pair of arms are pivotally coupled together by means of a respective hinge 76. Also as shown in FIG. 4, each of the panels 30 suspended from a respective one of the aforementioned support arms extends beyond the length of its associated arm. Thus, the width of each of the panels 30 is greater than the length of its associated arm from which it is suspended in order to provide an overlapping panel arrangement when the folding door 20 is in the closed position. FIG. 4 shows the rightmost three panels 34*a*, 34*b* and 34*c* in the closed position across an opening within the wall 33. On the other hand, the three leftmost panels 34*a*, 34*b* and 34*c* are shown in the figure in the fully retracted, or open, position. During normal operation, displacement of the three right-hand panels and the three left-hand panels is coordinated such that both are either in the open or closed positions at the same time. The arrangement of FIG. 4 may be achieved by disconnecting one set of three panels from the drive chain and sprocket arrangement and manually displacing the thus disconnected panels or by providing independent drive arrangements for the right-hand panels and the left-hand panels.

Figure 5:
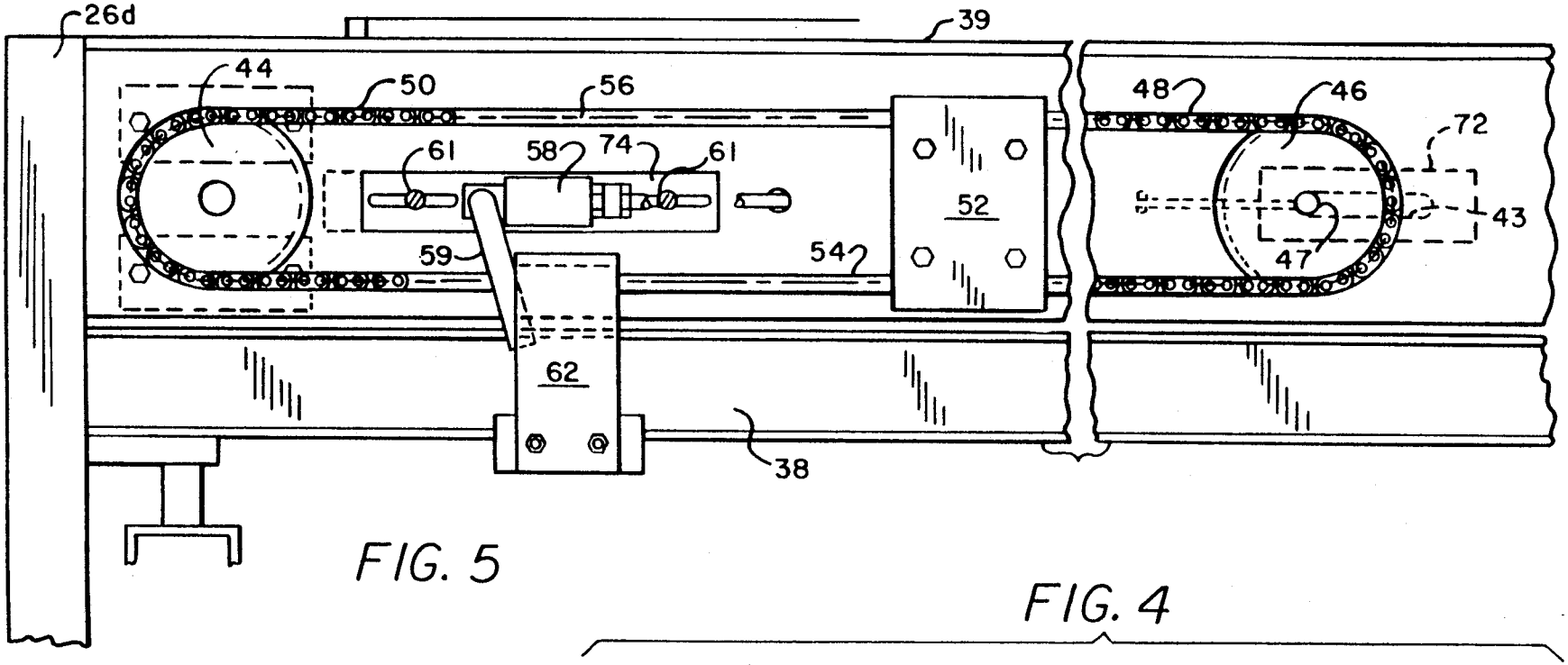
FIG. 5 is a front view of the drive and support arrangement located within the header portion of the folding door of the present invention.

Referring to FIG. 5, there are shown additional details of the drive chain arrangement used to open and close the folding door. Full leftward displacement of the left moving bracket 62 results in its engagement with a trip arm 59 of the open limit switch 58. Pivoting displacement of the trip arm 59 causes the open limit switch 58 to send a full open signal to the drive motor (not shown in FIG. 5 ) for terminating further outward displacement of the left moving bracket 62. The open limit switch 58 is mounted to a slotted adjustment plate 74 which, in turn, is securely attached to the support beam 39 via a pair of threaded mounting pins 61. The slots within the adjustment plate 74 allow its position along the length of the support beam 39 to be adjusted as desired. This permits the full open position of the folding door to be adjusted as desired along the length of the I-beam 38. A similar mounting arrangement is provided for a close limit switch 60 as shown in FIGS. 2 and 3 to permit the extent of overlap of the two center panels to be fixed as desired when the folding door is closed and the left moving bracket 62 engages the close limit switch. The other end of the support beam 39 is also provided with an elongated slot 43 through which is inserted an idle shaft 47 upon which the idle sprocket 46 is rotationally mounted. The idle shaft 47 is securely maintained in position within the slot 43 by conventional means such as an adjustment block 72. The position of the idle shaft 47 may be fixed along the length of the slot 43 in order to provide a desired tension in the drive chain arrangement illustrated in FIG. 5 .

Referring to FIGS. 6 through 10, there are shown various views of an arrangement for supporting and allowing the linear displacement of the various panels 30 of the folding door along the I-beam 38. As shown in FIG. 6 , the generally "C"-shaped support beam 39 is disposed immediately above and in contact with the I-beam 38. These two members are disposed within the header assembly 26 and are preferably coupled together along the respective lengths thereof. The header assembly further includes a bottom panel 29, with a slot disposed between the forward edge of the bottom panel and a forward portion of the header assembly 26. The combination of the drive motor 40 and gear box 42 is coupled to an aft portion of the support beam 39 by means of a mounting bracket 33 and mounting bolts. An upper clamp 80 is used to couple the right moving bracket 64 to the upper section of the chain drive arrangement. Similarly, a lower clamp 82 is used to affix the left moving bracket 62 to a lower portion of the drive chain arrangement. A lower end portion of the left moving bracket 62 is coupled to a lateral portion of a trolley 70 disposed upon and supported by the I-beam 38. A similar arrangement for attaching a lower portion of the right moving bracket 64 to the I-beam by means of a trolley is provided for, although the details of this arrangement are not shown in FIG. 6 for simplicity.

The details of the structure and operation of the trolley 70 as shown in the various views of FIG. 6, 8, 9 and 10 will now be described. The trolley includes a generally U-shaped base 84 having facing ends thereof turned inward. The trolley base 84 includes a generally flat center portion from which extend upward in an inclined manner the forward and aft flanges 104 and 106. The terms "forward" and "aft" are used relative to the front and rear of the folding door 20 and its associated header assembly 26. A front main wheel 90 is rotationally mounted to the forward flange 104, while a rear main wheel 92 is rotationally mounted to the aft flange 106 by means of a respective mounting/pivot pin inserted through the flange. Similarly, a first pair of forward side rollers 86 and a second pair of aft side rollers 88 are rotationally mounted to respective front and aft portions of the trolley's base 84. Each of the aforementioned forward and aft side rollers 86, 88 is maintained in position by and rotates about a respective mounting/pivot pin inserted through the trolley's base 84. A retaining pin 108 is inserted through each mounting/pivot pin. Each of the forward and aft main wheels 90 and 92 is adapted to engage and ride upon a lower portion of the I-beam 38. Similarly, each pair of the forward and aft side rollers 86, 88 is adapted to engage a lower, lateral portion of the I-beam 38. The front and rear main wheels 90, 92 thus provide rolling support for the trolley 70 upon the I-beam 38, while the forward and aft pairs of side rollers 86, 88 prevent lateral displacement of the trolley relative to the I-beam. In this manner, the trolley 70 is prevented from becoming misaligned with respect to the I-beam 38 regardless of the direction or magnitude of force imposed upon the trolley. A mounting plate 94 attached to the forward lateral face of the trolley's base 84 includes a pair of mounting bolts 95 to facilitate secure coupling of the trolley to a lower end portion of the left moving bracket 62 as shown in FIG. 6. The various pairs of facing rollers described above provide the trolley with a self-aligning feature by means of which the trolley is more securely and stably mounted to the I-beam 38.

Coupled to a lower portion of the trolley by means of the combination of a nylon bushing 96 and retaining pin 98 is a coupling bracket 100. The retaining pin 98 permits rotational displacement of the coupling bracket 100 about the longitudinal axis of the retaining pin. Similarly, with the nylon bushing 96 inserted from below through an aperture within the coupling bracket 100, the coupling bracket is free to rotate about the nylon bushing as well as about the trolley 70. These two rotational degrees of freedom of the coupling bracket 100 facilitate its rotational displacement as well as that of a folding door panel suspended therefrom about the trolley 70 and support I-beam 38. This freedom to rotate upon lateral displacement of the coupling bracket 100 and support arm to which it is coupled such as in response to displacement of a panel suspended from the support arm due to vehicular impact or wind pressure reduces the possibility of the trolley 70 coming off the I-beam 38 under adverse conditions. Inserted through the coupling bracket 100 and adapted to securely engage a support arm from which a door panel is suspended are a pair of coupling pins 102. As shown in FIG. 6, the coupling pins 102 securely attach the center arm 136 to the coupling bracket 100.

As shown in FIGS. 6 and 7, a lower portion of the center arm **36*a* is provided with a slot extending the length thereof. Similarly, the upper edge of each of the panels 30 is provided with a pair of retaining strips 30*a* on facing surfaces thereof. Each of the panels is attached to its associated support arm by inserting the upper edge of the panel in the support arm's slot and drawing the panel within and along the length of the support arm. With the panel 30 extending through the slot within the support arm 36*a*, the pair of facing retaining strips 30*a* engage an inner portion of the support bar and maintain the panel securely in position therein. A self-tapping screw 78 is inserted through the center arm 36*a* so as to engage an upper edge of the panel 30 and prevent the panel from sliding out one end of the center arm. Other means may be used to maintain the panel 30** securely within its associated support arm.

The retaining strips **30*a* may be comprised of PVC and attached to the main panel by heat welding, or sealing, in combination with the application of pressure. Another approach for affixing the retaining strips 30*a* to the panel 30 may be by means of a PVC weld bead disposed between the panel and each of the retaining strips and heated to the required temperature to effect adherence. Finally, high strength adhesives may be used to affix the pair of retaining strips 30a to the facing surfaces of the panel 30** adjacent the upper edge thereof.

Figure 11:
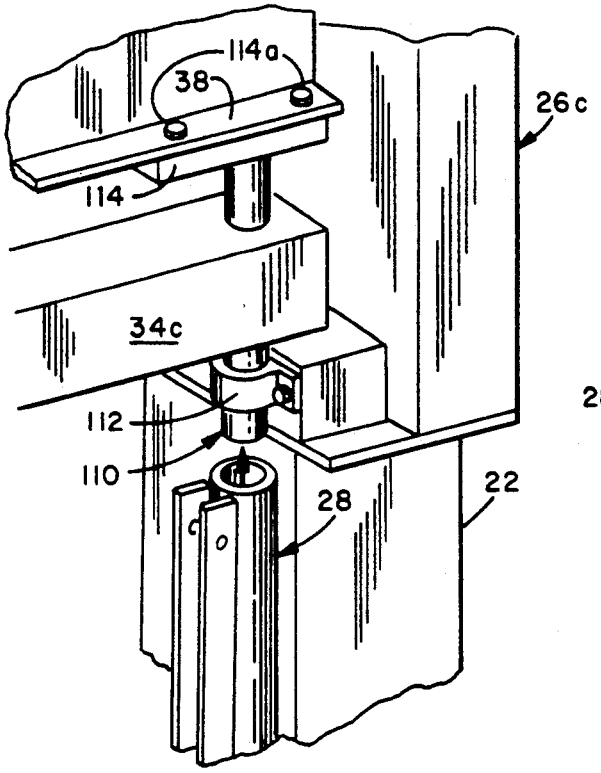
FIG. 11 illustrates the manner in which an upper portion of the folding door is pivotally mounted to a stile.

Referring to FIG. 11, there is shown the manner in which an end support arm 34c is attached to a stile 28 which, in turn, is securely mounted to the side frame 22. As shown in FIG. 11, a mounting bracket 114 is attached to a lower, end portion of the I-beam 38. Coupled to and extending downward from the mounting bracket 114 is an arm pivot shaft 110 which is inserted through an aperture within and adjacent to the end of the support arm 34c. A lower end of the arm pivot shaft 110 is coupled to the end panel 26c by means of an upper pivot bracket 112. The lower end of the arm pivot shaft 110 is further inserted in an aperture in the upper end of the stile 28. The right end panel 26c of the header assembly is positioned upon and securely attached to the side frame 22. This mounting arrangement permits the end support arm 34c to be freely rotated relative to the side frame 22 about a generally vertical axis through the stile 28. In a preferred embodiment, mounting bracket 114 is provided with a plurality of spaced slots or apertures (not shown) along its length to allow its position along the length of the I-beam 38 to be adjusted as desired by inserting mounting pins 144a through a selected pair of slots or apertures. Similarly, the upper pivot bracket 112 is also provided with a plurality of spaced slots or apertures (also not shown) along its length to allow its position along the depth of the end panel 26c to be adjusted as desired by inserting mounting pins 112a through a selected pair of sIots or apertures. By adjusting the position of the mounting bracket 114 along the length of the I-beam 38 and the position of the upper pivot bracket 112 along the depth of the end panel 26c, with the lower end of the pivot shaft 110 inserted in the upper end of the stile 28, the support arms from which the trolleys are suspended may be aligned in a plane parallel with the I-beam with the folding door in both the open and closed positions.

Figure 12:
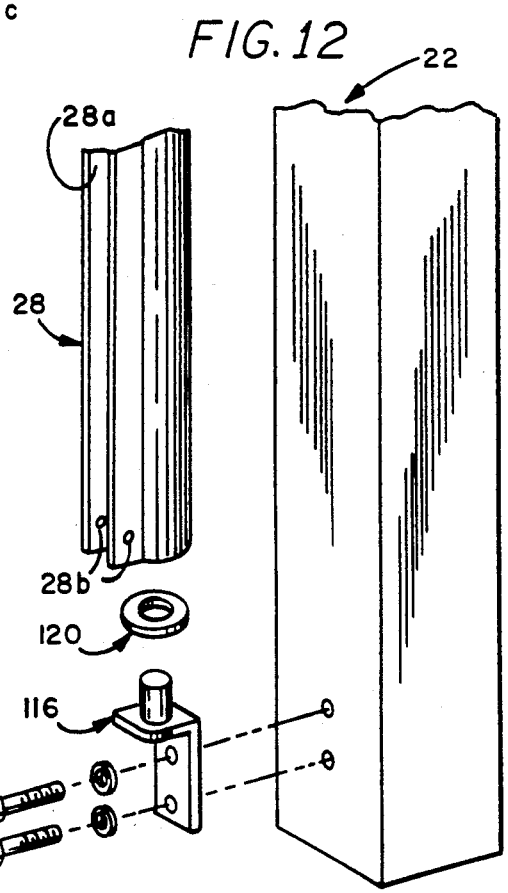
FIG. 12 illustrates the details of the manner in which a lower portion of the folding door is pivotally mounted to a stile.

Referring to FIG. 12, there is shown the manner in which a lower end of the stile 28 is pivotally coupled to an adjacent lower end of the side frame 22 by means of a lower pivot bracket 116. The lower pivot bracket 116 is securely mounted to an inner surface of the stile 22 by means of a pair of threaded mounting pins 118. An upper, cylindrically shaped portion of the lower pivot bracket 116 is adapted for insertion within the lower end of the stile 28. A flat washer 120 disposed between the lower end of the stile 28 and the lower pivot bracket 116 facilitates rotational displacement of the stile with respect to the mounting bracket as well as with respect to the side frame 22. The stile 28 is provided with a slot 28a along the length thereof which is adapted to receive an edge of the outermost panel along the length thereof. A plurality of spaced, aligned apertures 28b on each side of the slot 28a within the stile 28 are each adapted to receive a respective mounting pin for securely attaching a door panel to the stile along the length thereof. This arrangement permits both of the outermost folding door panels as well as their associated end support arms to be rotationally displaced about a generally vertical axis defined by a stile.

Figure 13:
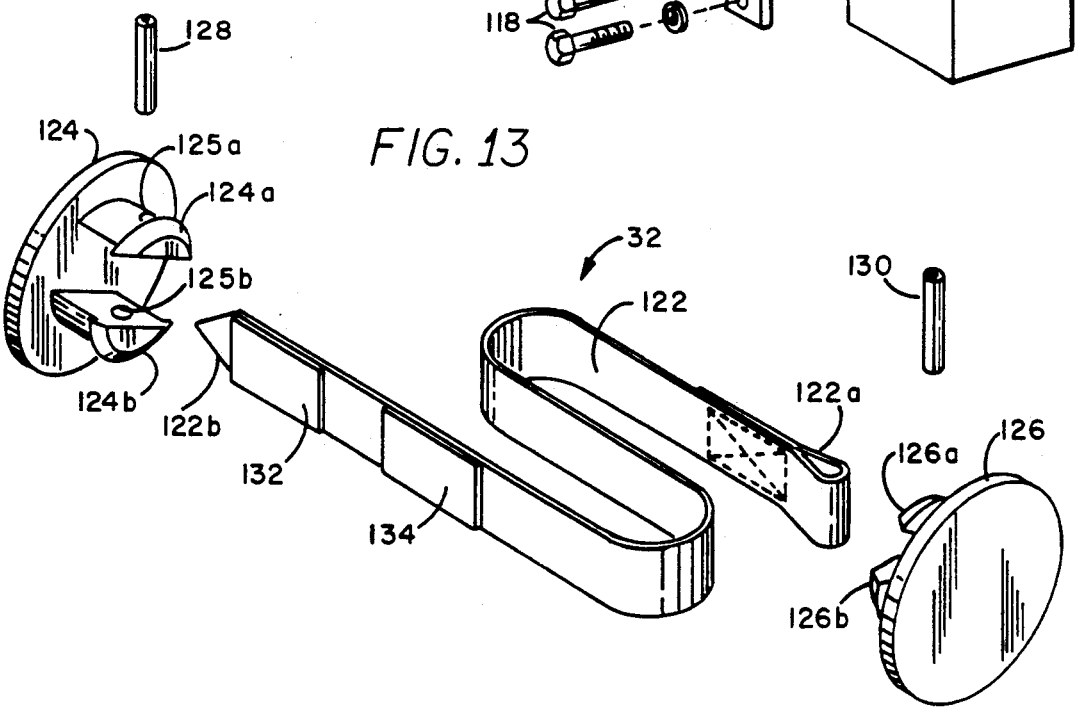
FIG. 13 is an exploded view of a breakaway retaining strap used for coupling adjacent panels in the folding door of the present invention.

Referring to FIG. 13, there is shown the details of a breakaway retaining strap 32 for coupling adjacent panels. The breakaway retaining strap 32 includes first and second end buttons 124 and 126 in combination with a flexible, elongated strap member 122 preferably comprised of a high strength material such as nylon. A first end of the strap member 122 is provided with a loop 122a, while a second end 122b of the strap member is tapered. Adjacent to the tapered end 122b of the strap member 122 is the combination of a Velcro hook portion 132 and a Velcro loop portion 134. The second end button 126 is provided with first and second flanges 126a and 126b having tapered distal ends to facilitate insertion of the end button through a circular aperture within a flexible panel of the folding door. The loop end 122a of the strap member 122 is positioned between the flanges 126a and 126b. A roll pin 130 is then inserted through the flanges 126a and 126b as well as through the loop end 122a of the strap member 122. The roll pin 130 may be of the expansion or split pin type to ensure that the pin is securely retained within the flanges of the end button 126. It is in this manner that the loop end 122a of the strap member 122 may be securely coupled to a door panel by means of the second end button 126.

The first end button 124 is similarly provided with a pair of spaced flanges 124a and 124b, each of which has a beveled distal end to facilitate insertion of the end button through a circular aperture in a door panel. The flanges 124a, 124b are each provided with a respective aperture 125a, 125b through which a roll pin 128 may be inserted and securely maintained in position therein. With the roll pin 128 inserted through the apertures 125a, 125b within the flanges 124a, 124b, the tapered end 122b of the strap member 122 is inserted between the roll pin and the flat portion of the end button 124. The tapered end 122b of the strap member 122 is then wrapped around the roll pin 128 permitting the Velcro hook portion 132 and the Velcro loop portion 134 to be positioned in mutual engagement. The first end button 124 is thus coupled to a second end of the strap member 122. The Velcro coupling arrangement at one end of the strap member 122 provides breakaway coupling between adjacent door panels. Thus, upon impact of one or more door panels with a moving vehicle, the breakaway retaining strap 132 separates allowing a pair of adjacent panels to be freely displaced relative to one another and preventing either a severing of the coupling member between the adjacent panels or damage to either of the panels. In addition, prior art panel coupling arrangements of the nonbreakaway type have resulted in large forces being applied not only to the panels, but also to the panel support and displacement structure requiring repair and replacement of the various components in the door's header assembly. The breakaway retaining straps 32 avoid this problem by allowing adjacent, coupled door panels to be easily separated upon impact with a moving vehicle and to be subsequently joined in restoring the integrity of the door without expensive repairs or the replacement of any components.

Figure 14:
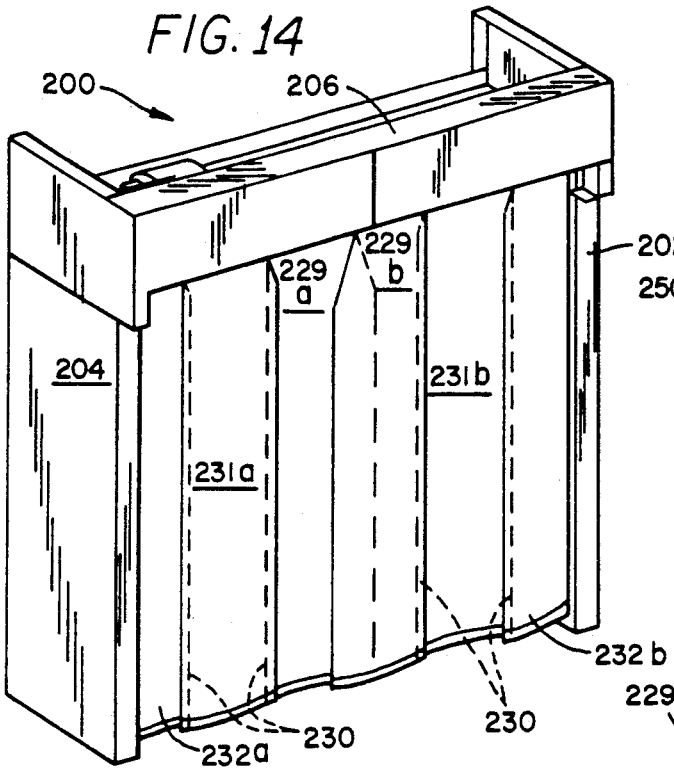
FIG. 14 is an upper, front perspective view of a preferred embodiment of the high speed folding door of the present invention.

Referring to FIG. 14, there is shown an upper, front perspective view of a high speed folding door 200 in accordance with a preferred embodiment of the present invention. As in the earlier described embodiment, the high speed folding door 200 of FIG. 14 includes a right side frame 202, a left side frame 204 and a header assembly 206. Disposed within the header assembly 206 are a plurality of spaced trolley and support arm combinations (not shown) to which an upper edge of each of the panels of the high speed folding door 200 is securely attached as described below. As shown, the folding door 200 includes left inner, intermediate and end, or outer, panels 229a, 231a and 232a as well as right inner, intermediate and end panels 229b, 231b and 232b. The three panels on the right are coupled together as are the three panels on the left as shown in FIG. 14. The three right hand and three left hand sets of panels are laterally displaced toward or away from the right and left side frames 202, 204 by a drive arrangement (not shown) such as previously described for opening and closing the aperture defined by the aforementioned side frames and header assembly 206.

The high speed folding door 200 shown in FIG. 14 which is described in the following paragraphs and illustrated in greater details in FIGS. 15 through 19 is particularly adapted for use where there is an extreme temperature differential between its two surfaces. Such an environment is typically encountered in covering the doorway of a freezer or in very cold climates. Seals are provided for sealing each edge of the door panels either with another adjacent panel or with an adjacent structure for environmentally isolating those areas on the opposite side of the doorway.

Figure 15:
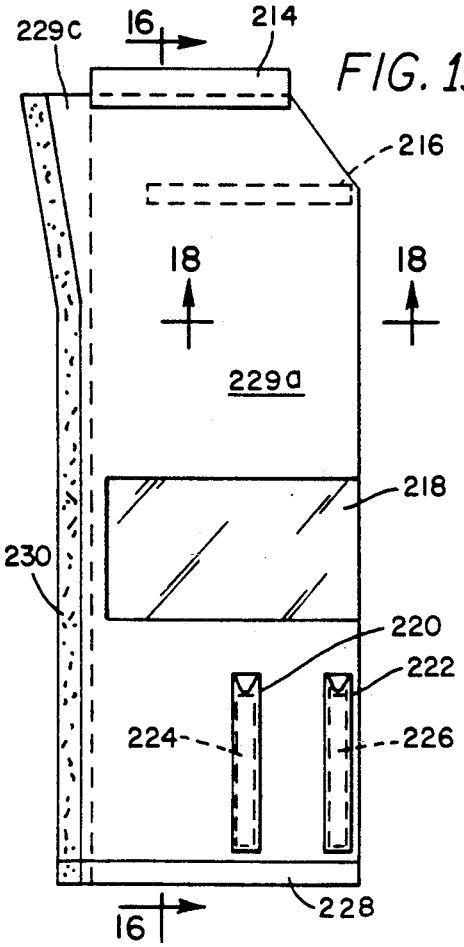
FIG. 15 is a front plan view shown partially in phantom of one of the panels used in the high speed folding door of FIG. 14.
Figure 16:
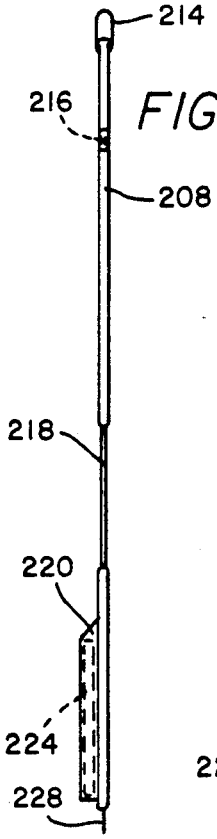
FIG. 16 is a sectional view of the door panel shown in FIG. 15 taken along sight line 16—16 therein.

Referring to FIG. 15, there is shown partially in phantom a plan view of one of the door panels 229a. The door panel 229a is generally planar and rectangular in shape and is preferably comprised of a multi-layer structure as described below. While the panel herein described in detail is the left inner panel 229a, this description is similarly applicable to all of the panels as they differ only in their general shape. Panel 229a may include a transparent vision panel 218 positioned therein. The vision panel 218 may be comprised of a low temperature PVC material or a Lexan thermal pane. The latter construction is preferred for the vision panel 218 in that it does not have to be heated to prevent condensation at very low temperatures because of the presence of a vacuum gap disposed between facing Lexan thermal panes in the panel 229a. An elongated, semi-rigid reinforcing member 216 which may be comprised of a conventional material such as fiberglass may be positioned within an upper portion of the panel 229a for reinforcement. The reinforcing member 216 may be sewn in place between the two facing layers forming the outer skin of the panel 229a as described below.

One or more pockets 220, 222 may be attached to an outer surface of the panel 229a. Disposed within each of the pockets 220, 222 is a respective weight 224, 226 for maintaining the panel 229a in a stretched condition so that it extends from the top to the bottom of the aperture across which the high speed folding door is positioned. Each of the pockets 220, 222 is preferably comprised of a high strength, flexible, impact resistant material such as Hypalon, while virtually any relatively heavy material, or body, may be positioned within the pockets for maintaining the panels in position with a pressure differential across the high speed folding door 200 such as when wind is incident upon the high speed folding door.

Attached to the lower edge of each of the panels is a sweeper strip 228. Each sweeper strip 228 is preferably on the order of two inches wide and is comprised of 35 ounce Neoprene. The sweeper strips 228 seal the bottom of the high speed folding door 200 with the lower surface defining the lower edge of the aperture across which the folding door extends. Attached to the inner edge of each of the outer panels 232a and 232b as well as to the outer edge of the two inner panels 229a and 229b is a respective Velcro strip 230. Similarly, both edges of each of the intermediate panels 231a and 231b are each provided with a respective Velcro strip 230. Thus, with each of the panels arranged in an overlapping manner with an immediately adjacent panel, or panels, each of the panels is coupled along its entire length to an immediately adjacent panel, or panels. Each pair of immediately adjacent Velcro strips 230 attached such as by sewing to adjacent panels is comprised of a hook and a loop arrangement for mutual coupling between adjacent edges of the panels. Coupled Velcro strips 230 provide a seal between immediately adjacent panels extending the full length of the panels and allow for separation of adjacent panels upon panel impact such as by a fork lift or other vehicle transiting the aperture across which the high speed folding door extends. Portion 208a of the panel 208 to which the Velcro strip 230 is attached such as by sewing is a single layer to facilitate assembly of the panel. The small uninsulated edge portion of the panel 208 does not appreciably affect the high insulating characteristics of the high speed folding door 200 of the present invention. It should be noted that the two inner panels 229a and 229b overlap when the door is closed but are not coupled together.

Figure 17:
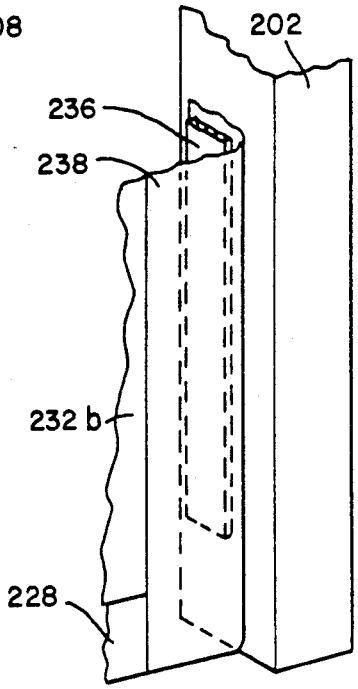
FIG. 17 is a perspective view shown partially in phantom of a lower portion of a continuous, sealed hinge for attaching a side panel of the high speed folding door to an adjacent side frame.

Referring to FIG. 17, there is shown the manner in which one of the outer panels 232b is attached in a sealed manner to the right side frame 202. A hinge 238 comprised of a flexible fabric is attached to the outer edge of the end panel 232a by conventional means such as heat sealing. The outer edge of the hinge 238, which extends the full length of the end panel 232b, is positioned in contact with the right side frame 202 and is maintained attached to the side frame by means of a pressure plate 236 which extends substantially the entire length of the hinge 238. The pressure plate 236 is preferably comprised of a high strength, rigid material such as metal and is securely attached to the outer frame 202 by conventional means such as mounting screws (not shown for simplicity). With one edge of the hinge 238 securely attached to the outer frame 202 and its other edge attached to the end panel 232b, as well as to the sweeper strip 228, a continuous leak proof seal is provided at the pivot point of the outer panel. The flexible fabric hinge 238 eliminates the need to fabricate and install a stile with its associated pivoting hardware and substantially simplifies installation and reduces the cost of the high speed folding door of the present invention.

Figure 18:
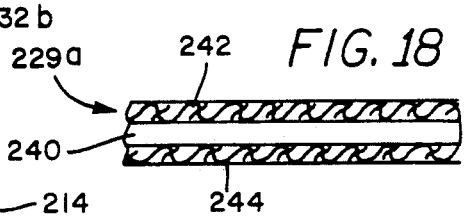
FIG. 18 is a partial sectional view of the high speed folding door panel of FIG. 15 taken along sight line 18—18 therein.

Referring to FIG. 18, there is shown a sectional view of a portion of the panel 229a shown in FIG. 15 taken along sight line 18—18 therein. The outer layers 242 and 244 of the panel 229a are preferably comprised of a rugged, weather resistant, heavy fabric such as Hypalon. The inner layer 240 may be comprised of virtually any insulating material, with polyethylene bubble pack having a foil laminated to both sides with a minimum thickness of 0.25 inch used in a preferred embodiment. The outer and inner layers should also preferably be comprised of a water vapor-resistant material which does not become excessively rigid at low temperatures. REFLECTIX TM insulation is used for the flexible insulating core layer 240 in a preferred embodiment.

Figure 19:
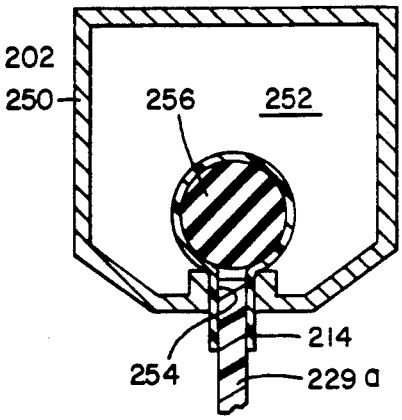
FIG. 19 is a sectional view of an upper edge portion of the high folding door of the present invention illustrating details of the manner in which each of the panels is coupled to and suspended from a respective trolley mounted support arm.

Referring to FIG. 19, there is shown a sectional view illustrating the details in which each of the panels of the high speed folding door of the present invention is suspended and maintained in position within the header assembly. As previously described and as shown in various figures including FIGS. 2, 3, 6 and 7, each of the trolley assemblies has in its lower portion a respective support arm from which one of the panels of the folding door is suspended. As shown in FIG. 19, a support arm 250 is comprised of a generally closed structure having an inner channel 252 therein and a lower slot 254 on a lower surface thereof. Each of the support arms 250 is generally linear and elongated and engages a respective one of the panels adjacent to its upper edge along substantially the entire width thereof. The support arms 250 are preferably comprised of a high strength material such as metal.

Referring back to FIG. 15, each of the panels is provided with a flexible hanger 214 in the form of a loop coupled to its upper edge along the width of the panel as shown in FIG. 19. The flexible hanger 214 may be coupled to its associated panel by conventional means such as by an epoxy cement or by heat sealing. The flexible hanger 214 is preferably comprised of a high strength, flexible fabric and is inserted into the lower slot 254 in the support arm 250 as shown in FIG. 19. An insert preferably in the form of a rubber cord 256 is then positioned within the flexible hanger 214 in a sliding manner in order to maintain the flexible hanger positioned within and coupled to the support arm 250. The flexible hanger 214 and the insert 256 extend over a substantial portion of the width of the panel 229*a*. The combination of the flexible hanger 214 and the rubber cord insert 256 provide the panel 229*a* with a pivoting mounting arrangement to the support arm 250 for reducing the flexing strain on the upper portion of the panel upon impact with a moving vehicle such as a fork lift. By thus reducing the flexing strain exerted on the upper portion of each of the panels, panel usable lifetime is substantially extended and the reliability of the high speed folding door is substantially increased. The flexing advantage of the panel mounting arrangement comprised of the flexible hanger 214 and the rubber cord insert 256 is particularly important in low temperature applications where most conventionally used materials, even low temperature PVC, become extremely brittle and subject to tearing and breakage.

Figure 20:
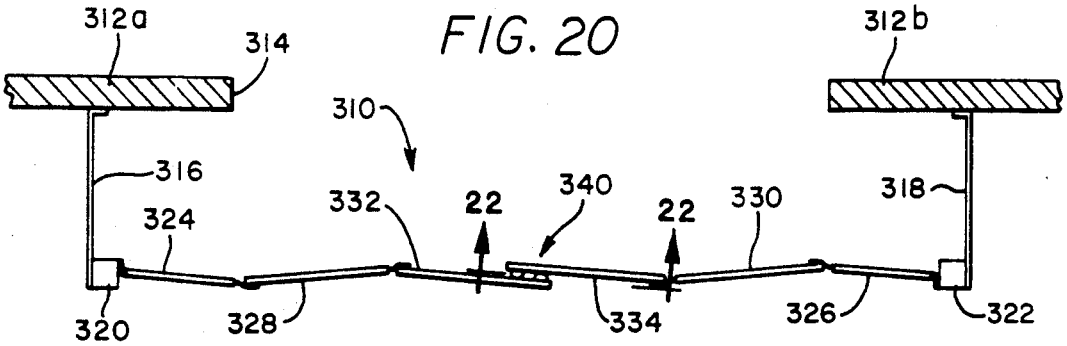
FIG. 20 is a top plan view of a folding door incorporating an overlapping seal between adjacent panels of the door in accordance with the present invention.

Referring to FIG. 20, there is shown a top plan view of a high speed folding door 310 incorporating an overlapping center seal 340 in accordance with the present invention. The high speed folding door 310 is disposed over and covers an opening 314 in a wall shown in the figure as including left and right wall sections 312*a* and 312*b*. The high speed folding door 310 is positioned between and supported by left and right side frames 316 and 318 which are respectively mounted to left and right wall sections 312*a* and 312*b*. While FIG. 20 shows the high speed folding door 310 displaced outwardly from the left and right wall sections 312*a*, 312*b*, the overlapping seal for an insulated folding door of the present invention is equally adapted for use with a folding door positioned within and extending across the wall opening 314.

The high speed folding door 310 is shown as including left and right outer panels 324 and 326 respectively mounted to the left and right side frames 316, 318 by left and right styles 320, 322. The left and right outer panels 324, 326 are pivotally coupled to the left and right styles 320, 322 by conventional means such as a mounting plate of fabric hinge as described earlier. Pivotally coupled to the left outer panel 324 is a left intermediate panel 328, while pivotally coupled to the right outer panel 326 is a right intermediate panel 330. Similarly, left and right inner, or lead, panels 332 and 334 are respectively coupled to the left and right intermediate panels 328 and 330. The coupling means between adjacent panels forms a seal between the panels, with details of one such coupling arrangement described below.

Figure 21:
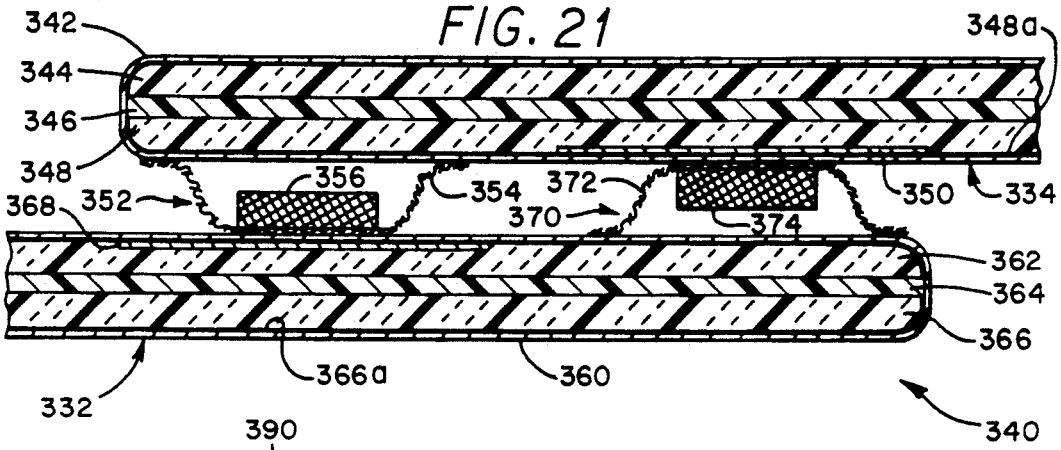
FIG. 21 is a horizontal sectional view of a portion of the folding door as shown in FIG. 20 illustrating details of the overlapping seal between adjacent panels of the door.

Referring to FIG. 21, there is shown a horizontal sectional view of adjacent portions of the left and right lead panels 332, 334 arranged in an overlapping manner when the folding doors are closed. The left lead panel 332 is comprised of a center, sheet-like partition 364 preferably comprised of a transparent material such as clear polyvinyl chloride. First and second insulating layers 362 and 366 are disposed on and attached to facing surfaces of the inner partition 364. Disposed about and enclosing the first and second insulating layers 362, 366 is an abrasion-resistant, flexible outer covering 360. A heat reflecting layer 366*a* is disposed intermediate the outer portions of the first and second insulating layers 362, 366 and the outer covering 360. The first and second insulating layers 362, 366 are each preferably comprised of REFLECTIX TM which is a bubble pack type of insulation having an outer reflective surface comprised of metal (aluminum) foil backing. The reflective layer reflects radiant heat back into the space adjacent to the folding door and prevents transmission of heat through the doorway opening. The inner partition 364 is comprised of a semi-rigid material which stabilizes the door panel and maintains it in position across the doorway opening.

Disposed adjacent to an edge of the left inner panel 332 is a collapsible nose 370. The collapsible nose 370 is comprised of a semi-rigid, flexible material which maintains its shape until impacted by a deforming force. The collapsible nose 370 is attached to the outer covering 360 of the left inner panel 330 by conventional means such as stitching or heat sealing. The collapsible nose 370 is tapered from bottom to top. Positioned upon and coupled to an inner portion of the collapsible nose 370 is a magnet 374. Positioned within the left inner panel 332 is a metal plate 368, which in a preferred embodiment is relatively thin and disposed intermediate the first insulating layer 362 and the outer covering 360.

The right inner panel 334 also includes an inner partition 346 and first and second insulating layers 344, 348 on opposing sides thereof. An outer covering 342, preferably comprised of hypalon, encloses the first and second insulating layers 344, 348. A reflecting layer 348*a* is disposed intermediate the first and second insulating layers 344, 348 and the outer covering 342. As in the case of the left inner panel 332, the right inner panel 334 also incorporates a metal plate 350 therein and has attached to an outer portion thereof a collapsible nose 352 comprised of a flexible fabric cover 354 and incorporating a magnet 356. In a preferred embodiment, the material of which the collapsible nose portion is made is more rigid than the outer covering of the panel. For example, the fabric cover 354 of the collapsible nose 352 is preferably comprised of a somewhat rigid neoprene, while the outer covering 342 is comprised of a less rigid hypalon. However, both portions of the panel could be comprised of hypalon with the collapsible nose material being more rigid than the hypalon of the panel outer covering.

As shown in FIG. 21, each of the magnets 356 and 374 is adapted for positioning when the folding door is closed in close proximity to a respective metal plate 368 and 350 in the other panel. This arrangement provides secure magnetic coupling between adjacent inner edges of the left and right panels 332, 334. Trapped air within each of the collapsible noses 352 and 370, in combination with the air space between the two collapsible noses when the folding door is closed as shown in FIG. 21, provide a high degree of environmental isolation between opposing sides of the left and right panels 332, 334. This further contributes to the insulating characteristics of the high speed folding door when closed.

Figure 22:
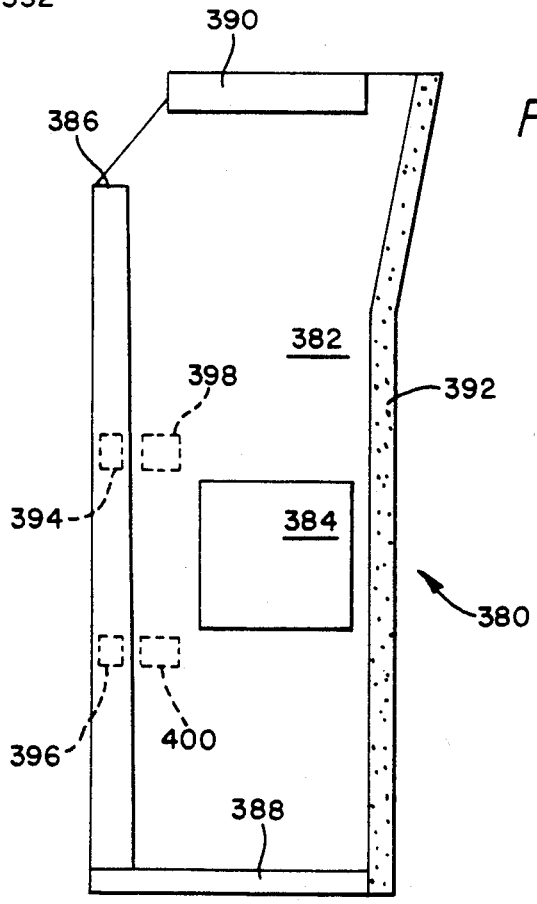
FIG. 22 is a plan view of a panel with a window in accordance with the present invention for use in a multi-panel folding door.

Referring to FIG. 22, there is shown a side plan view of a folding door panel 380 in accordance with the present invention. The folding door panel 380 includes an inner transparent partition 384 disposed between opposing insulating layers which are not shown in the figure for simplicity. Disposed over the insulating layers is an outer covering 382. The outer covering 382 as well as the two insulating layers are each provided with aligned apertures when the panel is assembled so as to form a window in the panel which is identified by the generally square portion of the center transparent partition 384. In a preferred embodiment, the center partition 384 in the folding door panel 380 which appears as a window in the figure is comprised of clear polyvinyl chloride.

Attached to an upper edge portion of the folding door panel 380 is a flexible hanger 390 in the form of a loop as previously described. The flexible hanger 390 allows the folding door panel 380 to be suspended from and supported by an overhead carriage mechanism which is not shown in the figure for simplicity. Attached to a lower edge of the folding door panel 380 is a sweeper strip 388. Disposed on one lateral edge of the folding door panel 380 is a Velcro hook strip 392 which is adapted for breakaway coupling to a complementary Velcro loop strip on a second, adjacent door panel which is not shown in the figure. The Velcro strip coupling arrangement permits adjacent door panels to be separated when the folding door is closed as when accidentally impacted by a moving object such as a vehicle passing through the doorway.

Disposed along an opposing edge of the folding door panel 380 is a collapsible nose 386 as previously described. The collapsible nose 386 incorporates a pair of magnets 394 and 396 which are adapted for magnetic coupling to metal plates in a second door panel which is not shown in the figure. Also included in the folding door panel 380 are a pair of spaced metal plates 398 and 400 which are adapted for magnetic coupling to magnets in the collapsible nose of another panel with which the folding door panel 380 is adapted for use. The collapsible nose strips with magnetic couplers in combination with the Velcro coupling strips provides the high speed folding door with a breakaway coupling for all of its panels upon impact with a vehicle. On the other hand, when the folding door is closed and suspended across an opening in a wall, each of the door panels is securely coupled to one or more adjacent panels to provide a high degree of heat sealing and environmental isolation between the spaces on opposing sides of the folding door.

There has thus been shown an insulated panel for use in a folding door having an overlapping seal for environmentally isolating the spaces on opposing sides of the door such as for maintaining a large temperature differential therebetween. The folding door panel includes a center transparent partition of semi-rigid material, a pair of insulating layers each positioned on an opposing side of the center partition, and an outer covering. The outer covering and insulating layers are provided with aligned apertures such that a portion of the transparent center partition forms a window in the door panel. Adjacent lateral edges of a pair of door panels are provided with collapsible nose strips which extend substantially the entire length of the panel and which are arranged in an overlapping manner when the folding door is closed. Incorporated in each collapsible nose strip as well as in an adjacent portion of the door panel are a magnet and metallic plate to provide magnetic coupling between overlapping adjacent edges of two such folding door panels.

While particular embodiments of the present invention have been shown and described, it will be obvious to those skilled in the art that changes and modifications may be made without departing from the invention in its broader aspects. While the overlapping seal of the present invention has been described as coupling adjacent lead, or inner, panels, the inventive overlapping seal arrangement may be used in coupling any adjacent panels in a multi-panel folding door. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A folding door system for a doorway in a wall, wherein a header means and first and second side means disposed between a floor and the header means define an aperture adjacent the doorway, said door system comprising:

track means extending horizontally between said side means along said header means;

a plurality of trolley means supported from and movable independently along said track means from each of said side means;

support means extending downwardly from each trolley means;

pivotal means extending along each of said side means;

a plurality of vertically extending panel means, including side panel means and inner panel means, each of said side panel means being pivotally connected along one edge to said pivotal means, said inner panel means each having a front face, a rear face, an inner edge portion and a portion operatively connected to one of said support means;

coupling means for interconnecting proximate vertical edges of adjacent panel means;

means for moving a first lead trolley means and a depending first inner panel means along said track means between a doorway open position adjacent said first side means and doorway closed position;

means for moving a second lead trolley means and a depending second inner panel means along said track means between a doorway open position adjacent said second side means and a doorway closed position; and breakaway double interlocking seal means disposed on overlapping portions of the first and second inner two panel means, said seal means comprising a collapsible nose strip on each of said inner panel means, the collapsible nose strip on the first inner panel means being disposed adjacent said inner edge portion and on the face of the first inner panel means overlapping the second inner panel means when the door is closed, the collapsible nose strip on the second inner panel means being disposed adjacent said inner edge portion and on the face of the second inner panel means overlapping the first inner panel means when the door is closed, said collapsible nose strips of each inner panel means extending toward and contacting the other inner panel means for connecting the first inner panel means to the second inner panel means in a sealed manner when the door is closed while allowing for separation of the inner two panel means when the door is opened.

2. The door system of claim 1 wherein said panel means are comprised of transparent polyvinyl chloride.

3. The door system of claim 2 wherein each of said collapsible nose strips includes an enclosed pocket of semi-rigid, resilient material.

4. The door system of claim 2 wherein said interlocking seal means further comprises magnetic means disposed within said collapsible nose strips for connecting the first inner panel means to the second inner panel means.

5. The door system of claim 4 further including a plurality of metal plates, operatively connected to each of said inner panel means and adapted for magnetic coupling to said magnetic means in the other inner panel means.

6. The door system of claim 2 wherein said pivotal means includes a stile pivotally attached to one of said side means and also attached to an edge of said side panel means, and an arm pivot shaft supported by said track means.

7. The door system of claim 2 wherein said pivotal means includes a flexible fabric hinge secured along one edge to one of said side means and along its other edge to an edge of said side panel means.

* * * * *